US007545400B2

(12) United States Patent
Ahn

(10) Patent No.: US 7,545,400 B2
(45) Date of Patent: Jun. 9, 2009

(54) IMAGE FORMING APPARATUS AND METHOD OF CONTROLLING TOP MARGIN OF PRINTING MEDIUM IN IMAGE FORMING APPARATUS

(75) Inventor: Byung-sun Ahn, Suwon-si (KR)

(73) Assignee: Samsung Electronics Co., Ltd., Suwom-Si (KR)

( * ) Notice: Subject to any disclaimer, the term of this patent is extended or adjusted under 35 U.S.C. 154(b) by 437 days.

(21) Appl. No.: 11/262,709

(22) Filed: Nov. 1, 2005

(65) Prior Publication Data

US 2006/0092265 A1 May 4, 2006

(30) Foreign Application Priority Data

Nov. 3, 2004 (KR) ..... 10-2004-0088565

(51) Int. Cl.
*B65H 5/06* (2006.01)
*B41J 13/00* (2006.01)

(52) U.S. Cl. ..... 347/139; 347/104; 347/218; 347/264

(58) Field of Classification Search ..... 347/104, 347/139, 153, 164, 218, 264
See application file for complete search history.

(56) References Cited

FOREIGN PATENT DOCUMENTS

| | | |
|---|---|---|
| JP | 8-076546 | 3/1996 |
| JP | 09-086715 | 3/1997 |
| JP | 2000-143036 | 5/2000 |
| JP | 2004-037916 | 2/2004 |
| JP | 2004-053669 | 2/2004 |
| KR | 2000-0056713 | 9/2000 |

OTHER PUBLICATIONS

Computer-generated translation of JP 09-086715.*
Computer-generated translation of JP 2004-037916.*
Computer-generated translation of JP 2000-143036.*
Computer-generated translation of JP 2004-053669.*
English translation of JP 09-086715 cited in the IDS filed on Jun. 12, 2006.*

* cited by examiner

*Primary Examiner*—Huan H Tran
(74) *Attorney, Agent, or Firm*—Staas & Halsey LLP

(57) ABSTRACT

An method of controlling a feeding velocity of a printing medium in an image forming apparatus, and an image forming apparatus to perform the method, the method including sensing a time between two points on a feeding path on which the printing medium is moving, and regulating the feeding velocity of the printing medium according to the sensed time.

22 Claims, 9 Drawing Sheets

IMAGE FORMING APPARATUS AND METHOD OF CONTROLLING TOP MARGIN OF PRINTING MEDIUM IN IMAGE FORMING APPARATUS

CROSS-REFERENCE TO RELATED APPLICATIONS

This application claims the benefit of Korean Patent Application No. 2004-88565, filed Nov. 3, 2004, in the Korean Intellectual Property Office, the disclosure of which is incorporated herein by reference.

BACKGROUND OF THE INVENTION

1. Field of the Invention

The present invention relates to an image forming apparatus. More particularly, the present invention relates to a method of controlling a top margin to uniformly regulate a position of an image on a printing medium, and an image forming apparatus employing the method.

2. Description of the Related Art

A top margin of a printing medium refers to a non-image area on the printing medium. More specifically, the top margin refers to a portion from a leading end to a position where an image starts to be transferred. Therefore, control of the top margin of the printing medium refers to the control of the transferring position of the image on the printing medium.

FIG. 1 is a sectional view schematically illustrating a conventional color image forming apparatus. Referring to FIG. 1, the color image forming apparatus comprises four photoconductive drums 10 whereon electrostatic latent images are formed, a laser scanning unit 12 to generate the electrostatic latent images on the respective photoconductive drums 10, four developing units 14 to change the electrostatic latent images into visible images, four transferring units 16 to transfer the visible images onto a printing medium, and a conveying belt 18 disposed between the photoconductive drums 10 and the transferring unit 16 to move the printing medium.

In the conventional image forming apparatus, upon receiving a printing command from a host device such as a computer, a controller (not shown) drives a pickup roller 20 to pick up the printing medium from a paper feeding cassette 24 or a multifunction paper feeding unit 26. The picked-up printing medium is conveyed between the conveying belt 18 and the photoconductive drums 10 by a feeding roller 22 at a constant velocity so as to have an image transferred thereupon. While being fed, the printing medium is detected by a registration sensor 28 mounted on a printing medium feeding path before entrance to the conveying belt 18. Also, the laser scanning unit 12 exposes the photoconductive drums 10 to a laser beam after a preset time from a point of detecting the printing medium. The preset time is determined as a difference between a time obtained through a distance from the registration sensor 28 to a transfer position TP and a feeding velocity of the printing medium, and a time taken from a laser-scanning position to the transfer position TP. Therefore, a setup of a transfer location on the printing medium depends on the predetermined feeding velocity and feeding distance of the printing medium.

However, since the pickup roller 20 or the feeding roller 22 can be abraded or stained with impurities, when the transfer position TP is determined as explained above, radiuses of the rollers 20 and 22 may change, thereby generating an error in the feeding velocity. Also, slips between the printing medium and the rollers 20 and 22 may cause an error in the feeding velocity of the printing medium. Due to the error, the transfer position TP for the image on the printing medium may be incorrectly determined. Furthermore, in a case in which the error is considerable, some images may miss being transferred onto the printing medium, thereby causing a loss of the information.

SUMMARY OF THE INVENTION

An aspect of the present invention is to solve the above and/or other problems and/or disadvantages, and to provide at least the advantages described below. Accordingly, an aspect of the present invention is to provide an image forming apparatus capable of starting transfer of image on a preferable position of a printing medium, and a method of controlling a top margin of the printing medium in the image forming apparatus.

Another aspect of the present invention is to provide an image forming apparatus capable of improving image quality, and a method of controlling a top margin of a printing medium in the image forming apparatus.

Yet another aspect of the present invention is to provide a color image forming apparatus capable of rapidly forming a monochromatic image, and a method of controlling a top margin of a printing medium in the color image forming apparatus.

Additional aspects and/or advantages of the invention will be set forth in part in the description which follows and, in part, will be apparent from the description, or may be learned by practice of the invention.

In order to achieve the above-described and/or other aspects of the present invention, there is provided an image forming apparatus comprising a feeding roller; a feeding motor to drive the feeding roller to move a picked-up printing medium; and a controller to control the feeding motor so as to regulate a feeding velocity of the printing medium according to a feeding time $T_{12}$ taken to move the printing medium within a predetermined section of a printing medium feeding path.

The image forming apparatus may further comprise a memory to store a lookup table comprising detailed values of a variation $\Delta P$ of a predetermined motor driving frequency corresponding to a comparison between the feeding time $T_{12}$ and a reference time $T_{R12}$, wherein the controller drives the feeding motor at the predetermined driving frequency during the feeding time $T_{12}$ and varies the predetermined motor driving frequency by adding or subtracting the variation $\Delta P$, selected from the lookup table based on the comparison between the feeding time $T_{12}$ and the reference time $T_{R12}$, with respect to the predetermined driving frequency P.

According to another aspect of the present invention, there is provided an image forming apparatus comprising a feeding roller; a feeding motor to drive the feeding roller to move a picked-up printing medium; and a controller to control a transfer position of an image on the printing medium by intermitting power transmitted from the feeding motor to the feeding roller during color printing, and to control the transfer position on the printing medium during monochromatic printing by regulating a feeding velocity of the printing medium according to a feeding time $t_{12}$ taken to move the printing medium with a predetermined section of the printing medium feeding path.

The image forming apparatus may comprise first and second photoconductive drums; first and second laser scanning units forming an electrostatic latent image on the first and the second photoconductive drums, respectively; a first sensor mounted on the printing medium feeding path; a second sensor mounted on the printing medium feeding path at a predetermined distance from the first sensor; a clutch connecting or disconnecting the feeding roller with respect to the feeding motor; a memory which stores a lookup table comprising detailed values of a variation ΔP of the predetermined motor driving frequency corresponding to a comparison between the feeding time $t_{12}$ taken to move the printing medium within the predetermined section and the reference time $t_{R12}$ and variation $\Delta t_{R2}$ of a time $t_{R2}$ to restore the predetermined motor driving frequency; and a controller.

When implementing color printing, the controller may disconnect the clutch upon detection of the printing medium by the second sensor. When the final laser scanning is performed by the first unit, the controller may change the reference time $t_{RL}$ to a first reference time $t_{RL1}$ which is determined by a distance between the first laser scanning unit and the transfer position TP, and connect the clutch after the first reference time $t_{RL1}$, and when the final laser scanning is performed by the second laser scanning unit, may change the reference time $t_{RL}$ to a second reference time $t_{RL2}$ which is determined by a distance between the second laser scanning unit and the transfer position TP, and connect the clutch after the second reference time $t_{RL2}$.

When implementing monochromatic printing, the controller may drive the feeding motor at the predetermined motor driving frequency during the feeding time '$t_{12}$' and vary the predetermined motor driving frequency by adding or subtracting the variation Δp, selected from the lookup table based on the comparison between the feeding time '$t_{12}$' and the reference time '$t_{R12}$', with respect to the predetermined driving frequency 'p'. The controller may vary the reference time by adding or subtracting the variation Δp, selected from the lookup table based on the result of comparison between the feeding time '$t_{12}$' and the reference time '$t_{R12}$', and in the varied reference time after a point of detecting the printing medium by the sensor, restore the predetermined motor driving frequency after the varied reference time from when the second sensor detects the printing medium. Here, the feeding time '$t_{12}$' may refer to a time from when the first sensor detects the printing medium to when the second sensor detects the printing medium. However, the feeding time '$t_{12}$' may be a time taken from when the printing medium is picked up to when the printing medium is detected by a sensor mounted on the printing medium feeding path.

According to another aspect of the present invention, there is provided a method of controlling a top margin on a printing medium in an image forming apparatus, the method comprising feeding the printing medium at a constant velocity V within a predetermined section of a printing medium feeding path; and varying a predetermined feeding velocity of the printing medium according to an actual time $T_{12}$ taken to move the printing medium within the predetermined section.

According to another aspect of the present invention, there is provided a method of controlling a top margin in an image forming apparatus, the method comprising determining whether color printing is requested; regulating, during color printing, a point of reaching a transfer position TP on a printing medium by intermitting transmission of power to a feeding roller; and regulating, during monochromatic printing, the point of reaching the transfer position TP on the printing medium by varying a predetermined rotating velocity of the feeding roller.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
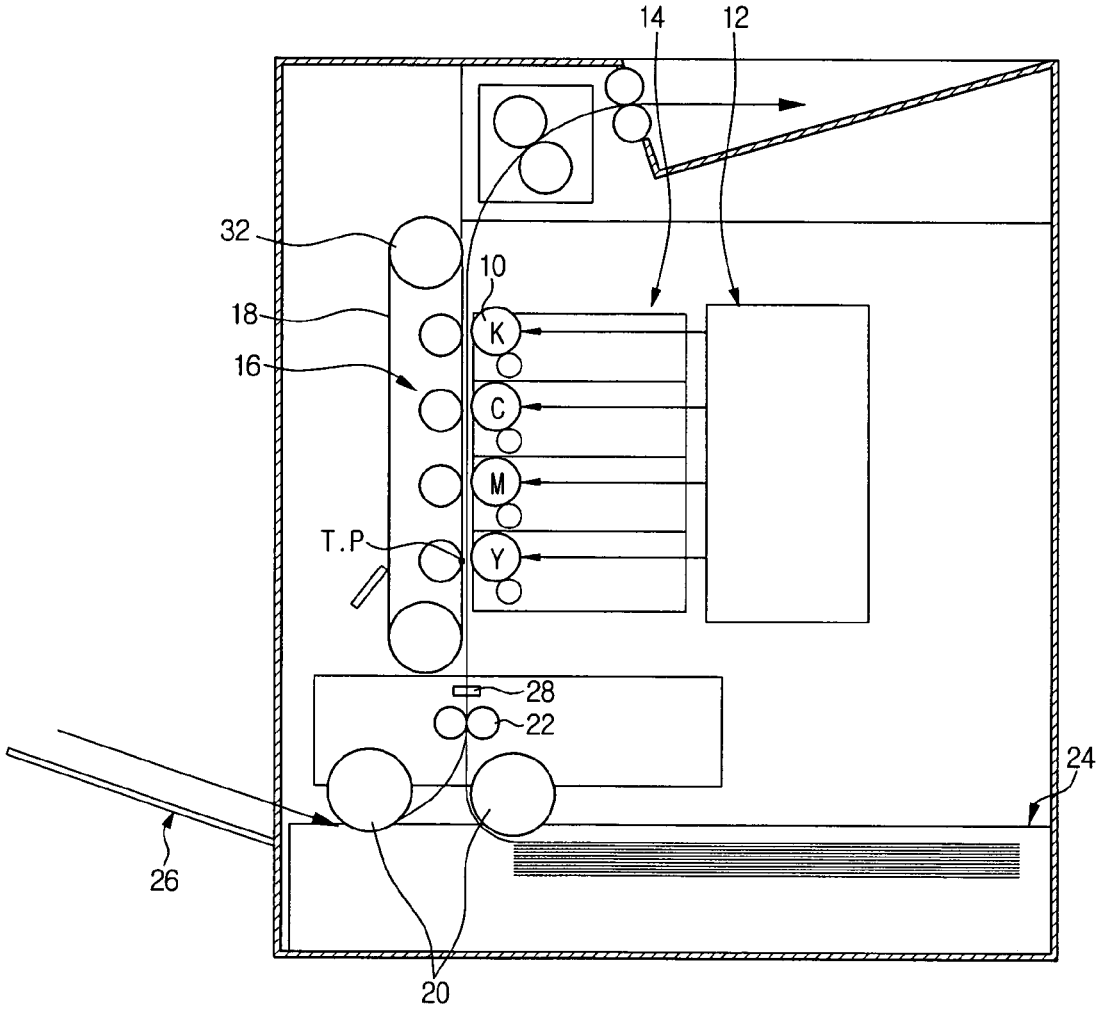
FIG. 1 (PRIOR ART)
FIG. 1 is a schematic sectional view illustrating a conventional image forming apparatus.

Reference will now be made in detail to the embodiments of the present invention, examples of which are illustrated in the accompanying drawings, wherein like reference numerals refer to the like elements throughout. The embodiments are described below to explain the present invention by referring to the figures.

In the following description, drawing reference numerals may be repeated to describe repeated elements in different drawings. Some matters may be defined in the description along with a detailed construction, however, these elements are merely provided to assist in a comprehensive understanding of the invention. Thus, it is apparent that the present invention may be carried out without those particularly described elements. Also, well-known functions or constructions may not be described in detail, so as to not obscure the invention in unnecessary detail.

Figure 2:
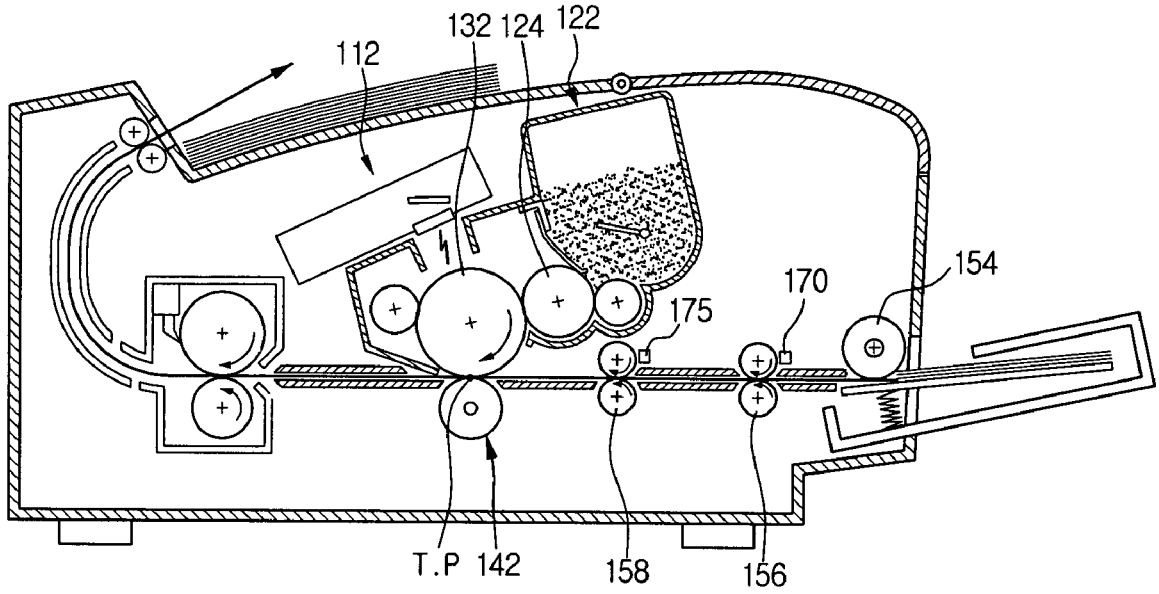
FIG. 2 is schematic sectional view illustrating a monochromatic image forming apparatus according to an embodiment of the present invention.
Figure 3:
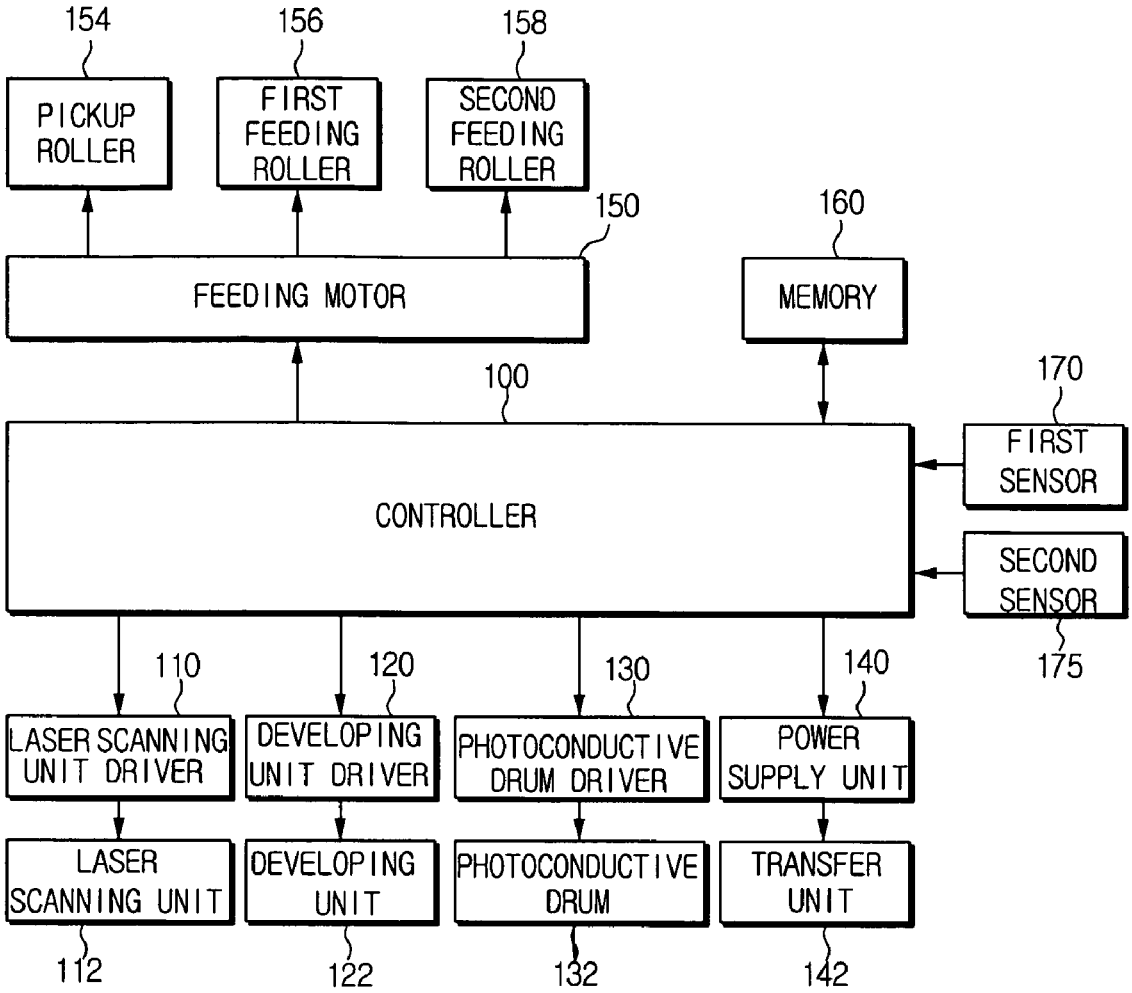
FIG. 3 is a control block diagram illustrating the monochromatic image forming apparatus of FIG. 2.

Referring to FIGS. 2 and 3, an image forming apparatus comprises a controller 100, a laser scanning unit driver 110, a developing unit driver 120, a photoconductive drum driver 130, a power supply unit 140, a feeding motor 150, a memory 160, and first and second sensors 170 and 175.

The controller 100 is connected to a host device such as a computer, for signal transmission. The controller 100 receives printing data and drives the respective drivers 110, 120, 130, 140, and 150 in accordance with the received printing data. Also, the controller 100 controls overall processes used in forming an image.

The laser scanning unit driver 110 drives a laser scanning unit 112 according to a signal from the controller 100. Accordingly, the laser scanning unit 112 scans a photoconductive drum 132 with a laser beam at a certain point of time to thereby generate an electrostatic latent image.

The developing unit driver 120 drives a developing unit 122, comprising a developing roller 124, according to a signal from the controller 100 to thereby change the electrostatic latent image formed on the photoconductive drum 132 into a visible image.

The photoconductive drum driver 130 drives the photoconductive drum 132 so that the laser scanning unit 112 and the developing unit 122 can perform exposing and developing, respectively, at an appropriate position.

The power supply unit 140 supplies power to a transfer unit 142 according to a signal from the controller 100, thereby transferring the visible image onto a printing medium such as a sheet of printing paper.

The feeding motor 150, according to a signal from the controller 100, drives a pickup roller 154 and first and second feeding rollers 156 and 158. The first and the second feeding rollers 156 and 158 are disposed on a printing medium feeding path at a predetermined distance from each other to move the printing medium to a transfer position TP.

The memory 160 stores data received from the host (not shown) and various other information used to operate the controller 100. For example, a lookup table used to vary frequency of the feeding motor 150 is stored to the memory 160. The lookup table will be described in greater detail hereinafter.

The first and the second sensors 170 and 175 are respectively disposed at the first and the second feeding rollers 156 and 158 to detect the printing medium being fed. Upon detection of the printing medium, the sensors 170 and 175 transmit appropriate information to the controller 100.

Hereinbelow, a method of controlling a top margin of the printing medium in the above image forming apparatus will be described in greater detail.

Figure 4:
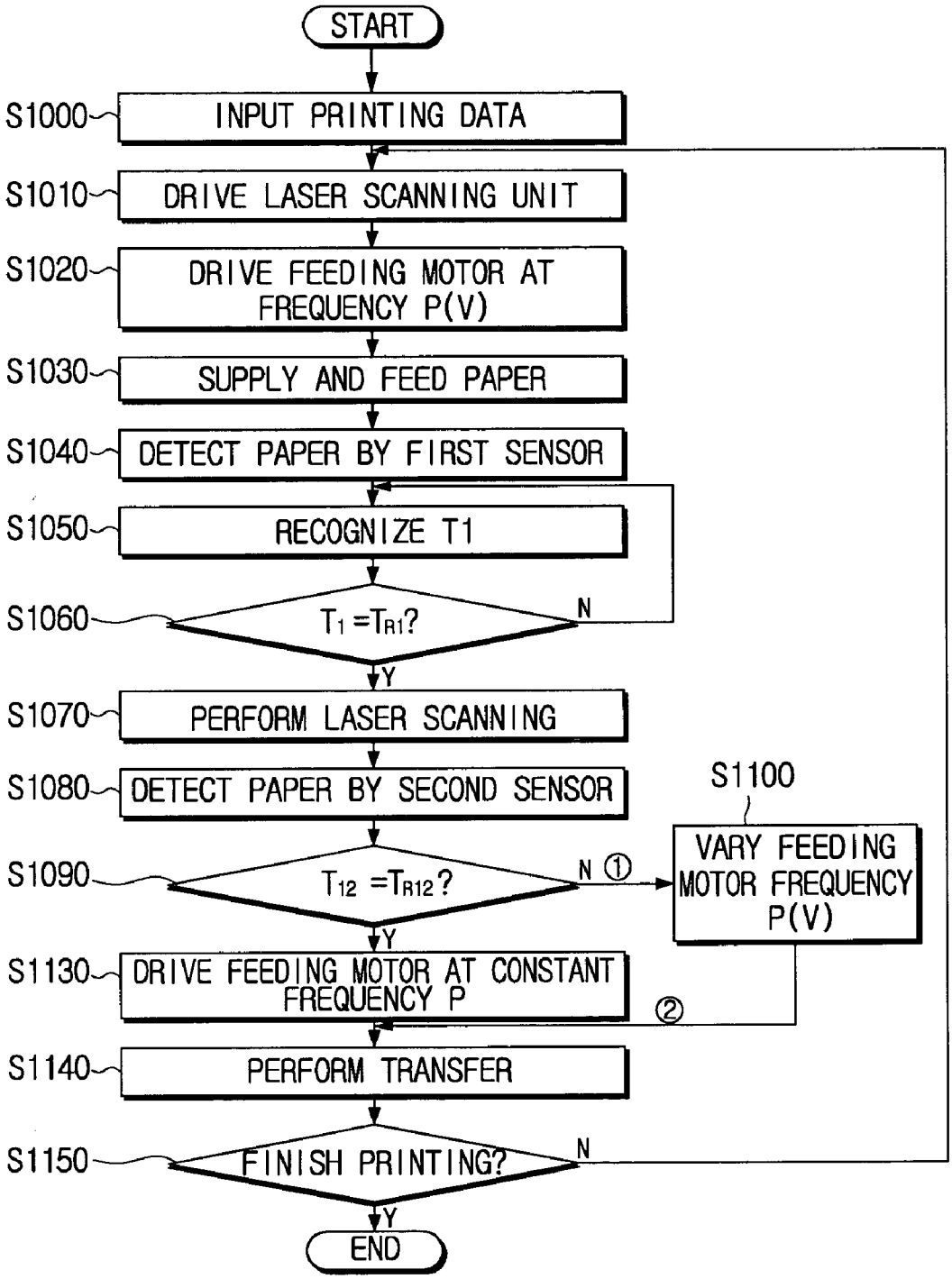
FIG. 4 is a flowchart illustrating a method of controlling a top margin of a printing medium in the monochrome image forming apparatus of FIG. 3.

Referring to FIGS. 3 and 4, printing data is input from a host device such as a computer (S1000). The controller 100 drives the laser scanning unit 112 (S1010), and drives the feeding motor 150 at frequency P (S1020). When the feeding motor 150 rotates at frequency P, the printing medium is fed at a velocity V. Therefore, as the pickup roller 154 and the first and the second feeding rollers 156 and 158, which are in connection with the feeding motor 150, rotate, the printing medium is fed (S1030). When the printing medium reaches the first sensor 170, the first sensor 170 detects the printing medium and transmits information regarding this to the controller 100 (S1040). Therefore, the controller 100 recognizes time $T_1$ (S1050), the point at which the first sensor 170 detects the printing medium, and determines whether the time $T_1$ is equal to a preset reference time $T_{R1}$ (S1060). Here, the preset reference time $T_{R1}$ refers to a time taken from when the first sensor 170 detects the printing medium to when a laser scanning operation begins. The reference time $T_{R1}$ is obtained by a difference between a time obtained through a distance from the first sensor 170 to a transfer position TP and a feeding velocity of the printing medium, and a time taken for a laser-scanning position on the photoconductive drum 132 to arrive at the transfer position TP, passing through other processes such as developing.

When the time $T_1$, taken from when the first sensor 170 detects the printing medium, is equal to the preset reference time $T_{R1}$, the controller 100 controls the laser scanning unit 112 to start the laser scanning operation (S1070). Then, when the printing medium reaches the second sensor 175 and is detected by the second sensor 175 (S1080), the controller 100 recognizes time $T_{12}$ taken for the printing medium to be moved from the first sensor 170 to the second sensor 175, and determines whether the time $T_{12}$ is equal to a preset reference time $T_{R12}$ (S1090). Here, the preset reference time $T_{R12}$ refers to a preferable time required for the printing medium to be moved from the first sensor 170 to the second sensor 175 when the feeding motor 150 is driven at frequency P and the printing medium is fed at a constant velocity V. However, discrepancy may occur between the time $T_{12}$ and the preset reference time $T_{R12}$, the time $T_{12}$ being the time actually required for the printing medium to be moved from the first sensor 170 to the second sensor 175, due to abrasion of the feeding rollers 156 and 158 and/or slip between the feeding rollers 156 and 158 and the printing medium. Hereinbelow, the time $T_{12}$ is referred to as 'actual time $T_{12}$'.

In the case in which the actual time $T_{12}$ is equal to the preset reference time $T_{R12}$, the controller 100 does not vary the driving frequency P of the feeding motor 150. Therefore, the printing medium moved up to the second sensor 175 is moved to the transfer position TP at the constant velocity V (S1130). Then, the controller 100 performs a transferring operation at the transfer position TP (S1140), determines whether the printing operation is completed (S1150), and finishes the printing processes if the printing operation is completed. If the processes are not finished, the controller 100 drives the laser scanning unit 112 again to repeat the image forming processes with another sheet of a printing medium.

Conversely, when the actual time $T_{12}$ is different from the preset reference time $T_{R12}$, the controller 100 varies the driving frequency P of the feeding motor 150 to thereby vary the feeding velocity V of the printing medium (S1100). By varying the feeding velocity V of the printing medium, the actual time $T_{12}$, taken for the printing medium to reach the second sensor 175, is compensated to approximate the preset reference time $T_{R12}$. Therefore, the image transferring position on the printing medium is set by varying the actual time $T_{12}$.

Figure 5:
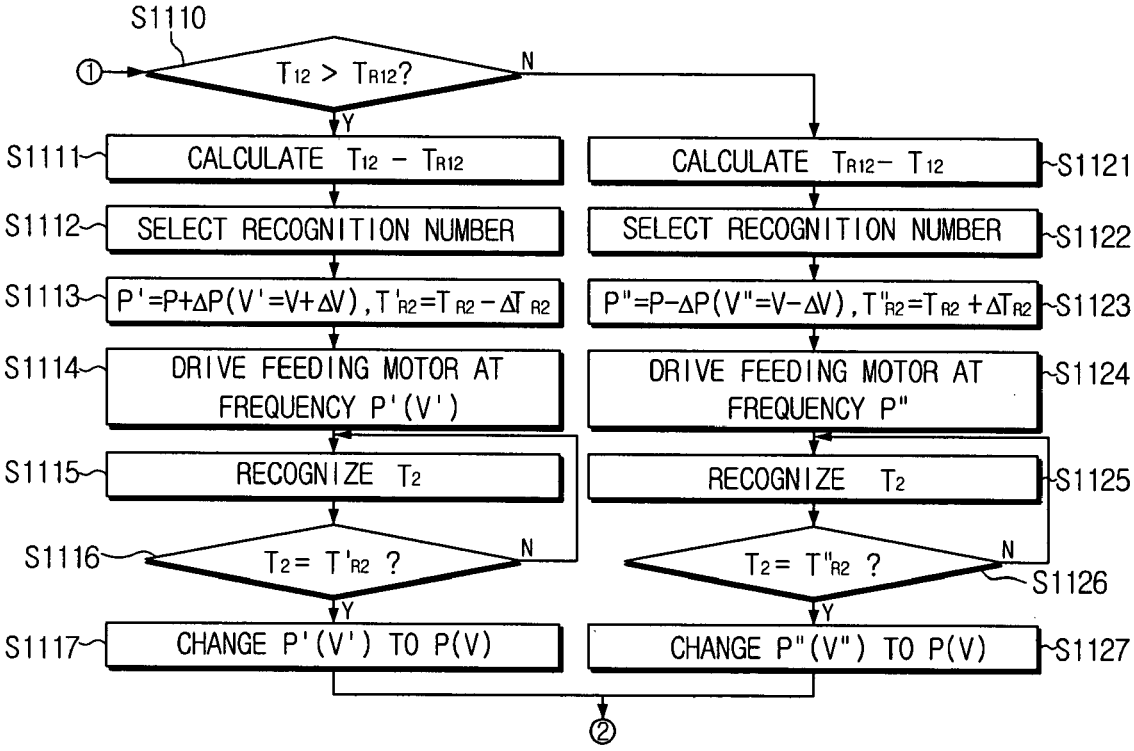
FIG. 5 is a flowchart illustrating a method of varying a feeding motor frequency P of FIG. 4.

Referring to FIG. 5, the processes of varying the feeding motor frequency P will now be described. First, it is determined whether the actual time $T_{12}$, which is the time actually taken for the printing medium to move from the first sensor 170 to the second sensor 175, is greater than the preset reference time $T_{R12}$ (S1110).

TABLE 1

Lookup Table

| Recognition No. | $\lvert T_{12} - T_{R12}\rvert$ | Variation ($\Delta P$) of feeding motor driving frequency (P) | Variation ($\Delta T_{R2}$) of preset time for restoration of feeding motor driving frequency (P) |
|---|---|---|---|
| 1 | $0 < \lvert T_{12} - T_{R12}\rvert \leqq \Delta T_1$ | $\Delta P_1$ | $\Delta T_{R21}$ |
| 2 | $\Delta T_1 < \lvert T_{12} - T_{R12}\rvert \leqq \Delta T_2$ | $\Delta P_2$ | $\Delta T_{R22}$ |
| 3 | $\Delta T_2 < \lvert T_{12} - T_{R12}\rvert \leqq \Delta T_3$ | $\Delta P_3$ | $\Delta T_{R23}$ |
| 4 | $\Delta T_3 < \lvert T_{12} - T_{R12}\rvert \leqq \Delta T_4$ | $\Delta P_4$ | $\Delta T_{R24}$ |
| 5 | $\Delta T_4 < \lvert T_{12} - T_{R12}\rvert \leqq \Delta T_5$ | $\Delta P_5$ | $\Delta T_{R25}$ |
| 6 | $\Delta T_5 < \lvert T_{12} - T_{R12}\rvert \leqq \Delta T_6$ | $\Delta P_6$ | $\Delta T_{R26}$ |
| 7 | $\Delta T_6 < \lvert T_{12} - T_{R12}\rvert \leqq \Delta T_7$ | $\Delta P_7$ | $\Delta T_{R27}$ |
| 8 | $\Delta T_7 < \lvert T_{12} - T_{R12}\rvert \leqq \Delta T_8$ | $\Delta P_8$ | $\Delta T_{R28}$ |
| 9 | $\Delta T_8 < \lvert T_{12} - T_{R12}\rvert \leqq \Delta T_9$ | $\Delta P_9$ | $\Delta T_{R29}$ |
| 10 | $\Delta T_9 < \lvert T_{12} - T_{R12}\rvert \leqq \Delta T_{10}$ | $\Delta P_{10}$ | $\Delta T_{R210}$ |

When the actual time T12 is greater than the preset reference time $T_{R12}$, the feeding velocity needs to be increased from the second sensor 175 to the transfer position TP because the actual time $T_{12}$ is too long for the proper transfer of an image to the printing medium. Data $T_{12}$-$T_{R12}$ is calculated to increase the feeding velocity V (S1111). According to a result of the caculation, a corresponding recognition number shown in Table 1, illustrating a lookup table, is selected (S1112). Although Table 1 shows the recognition number of 1 to 10 as an example, more numbers may be employed to sub-divide control of the feeding velocity V. Upon selection of the recognition number, variation $\Delta P$ of the feeding motor driving frequency P is determined according to the selected recognition number. Therefore, an updated feeding motor driving velocity frequency P' is determined by adding the variation ΔP to the feeding velocity frequency P (S1113). Additionally, according to the selected recognition number, the variation $\Delta T_{R2}$ of preset reference time $T_{R2}$ is selected to determine a point of time to restore the updated feeding motor driving frequency P' to the original feeding motor frequency P. Then, an updated preset restoration reference time $T_{R2}'$ is calculated by subtracting the variation $\Delta T_{R2}$ from the preset restoration reference time $T_{R2}$ (S1113).

After completion of the calculations, the printing medium is fed according to the updated feeding motor frequency P' (S1114). In this case, the feeding velocity V of the printing medium increases in proportion to the variation ΔP of the frequency. Therefore, the printing medium is able to correctly reach the transfer position TP by compensating the actual time the printing medium takes to move from the first sensor 170 to the second sensor 175.

However, in order to transfer the visible image from the transfer position TP of the photoconductive drum 132 onto the printing medium, the varied feeding velocity V' needs to be restored to the original feeding velocity V of the printing medium, because a rotational velocity of the photoconductive drum 132 and transferring velocity of the transfer unit 142 are set to the original feeding velocity V of the printing medium.

Therefore, the controller 100 recognizes an actual time $T_2$ taken from when the second sensor 175 detects the printing medium (S1115), and compares the actual time $T_2$ with a reference time $T_{R2}'$ to restore the varied feeding velocity V' of the printing medium (S1116). If the actual time $T_2$ is different from the reference time $T_{R2}'$, the controller 100 recognizes the actual time T2 again (S1115). When the actual time $T_2$ is equal to the reference time $T_{R2}'$, the controller 100 changes the varied feeding motor frequency P' to the original feeding motor frequency P so as to restore the varied feeding velocity V' to the original feeding velocity V (S1117). After the transferring operation, the controller 100 determines whether the printing operation is completed (S1150). When the printing operation is not completed, the controller 100 restarts the laser scanning operation (S1010) to keep the printing operation with a following sheet of the printing medium. Otherwise, the controller 100 finishes all the processes.

When the actual time $T_{12}$ taken from the first sensor 170 to the second sensor 175 is not greater than the preset reference time $T_{R12}$, which is contrary to the case in which the actual time $T_{12}$ is greater than the reference time $T_{R12}$, the recognition number is selected (S1122) by subtracting the actual time $T_{12}$ from the reference time $T_{R12}$ (S1121). The variation ΔP of the feeding motor driving frequency P is selected in accordance with the selected recognition number, and an updated driving frequency P" is calculated by subtracting the variation ΔP from the original feeding motor driving frequency P (S1123). Furthermore, in order to change the updated feeding motor driving frequency P" to the original feeding motor driving frequency P, variation $\Delta T_{R2}$ of the preset reference time $T_{R2}$ is selected according to the recognition number, and an updated reference time $T_{R2}''$ is calculated by adding the variation $\Delta T_{R2}$ to the original preset reference time $T_{R2}$ (S1123). Also, the printing medium is fed by driving the feeding motor 150 according to the updated feeding motor driving frequency P" (S1124), and the actual time T2, which is taken from when the second sensor 175 detects the printing medium, is recognized (S1125). When the actual time T2 is equal to the updated reference time $T_{R2}''$ as a result of comparison (S1126), the updated feeding motor driving frequency P" is changed to the original feeding motor driving frequency P (S1127) for the transferring operation (S1150). After the transferring operation, it is determined whether the printing operation has been completed.

In the present embodiment, the method of controlling the transfer position TP on the printing medium has been described, including the first and the sensors 170 and 175 mounted on the printing medium feeding path. However, the same effects as in the above embodiment can be acquired by changing the feeding velocity from the second sensor 175 to the transfer position TP based on time taken from a point of picking up the printing medium to a point of the printing medium reaching the second sensor 175, with the first sensor 170 omitted.

Figure 6:
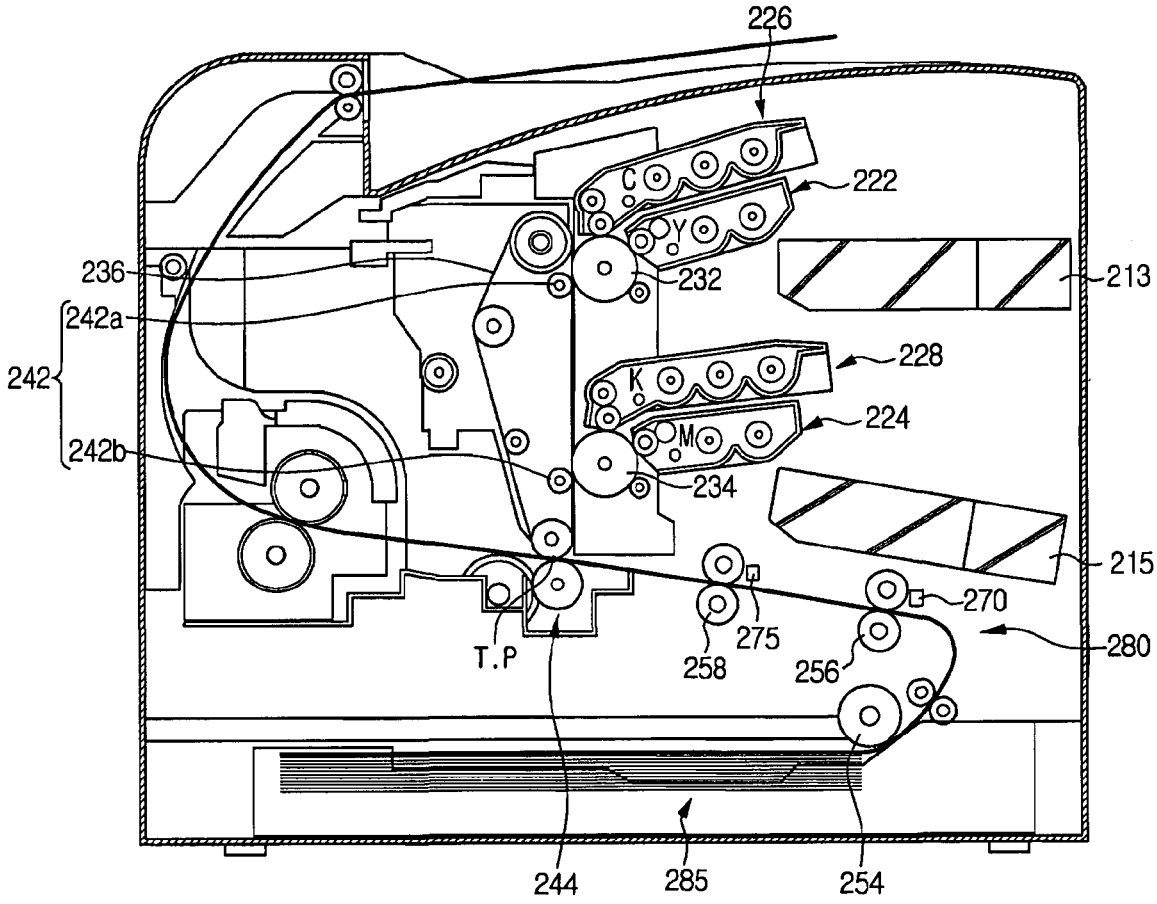
FIG. 6 is a sectional view schematically illustrating a color image forming apparatus according to another embodiment of the present invention.
Figure 7:
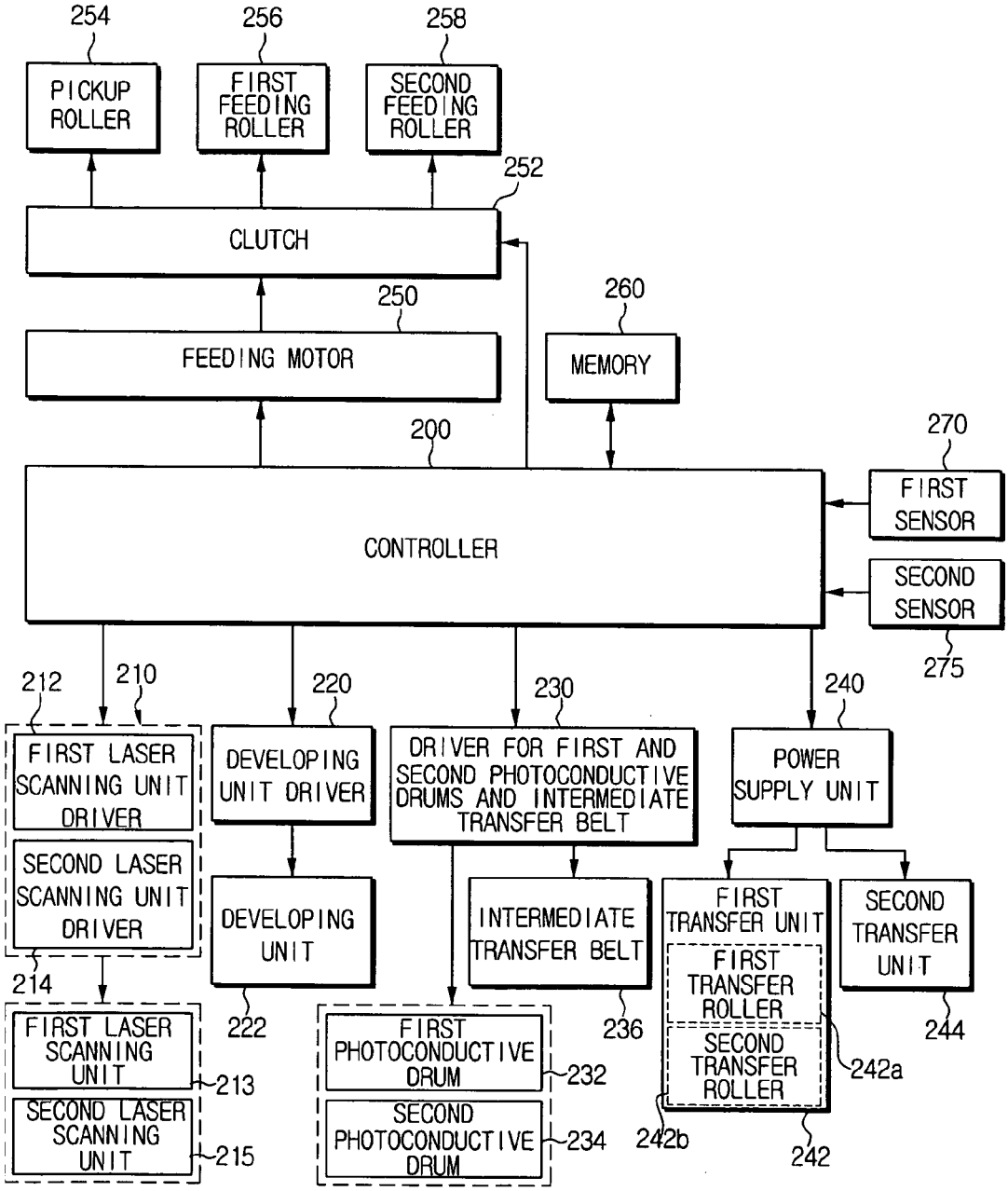
FIG. 7 is a control block diagram illustrating a color image forming apparatus of FIG. 6.

FIGS. 6 and 7 are views illustrating the structure of a color image forming apparatus according to another embodiment of the present invention. Referring to FIGS. 6 and 7, the color image forming apparatus comprises a controller 200, a laser scanning unit 210, a developing unit driver 220, a driver 230 for a photoconductive drum and intermediate transfer belt (ITB), a power supply unit 240, a feeding motor 250, a memory 260, and first and second sensors 270 and 275.

The controller 200 is connected with a host device such as a computer, for signal transmission, in the same manner as the previously described embodiment of the present invention. Therefore, the controller 200 receives printing data, thereby driving the respective drivers 210, 220, 230, 240, and 250, and regulates the overall processes for image formation.

The laser scanning unit driver 210 comprises a first laser scanning unit driver 212 to expose a first photoconductive drum 232 to develop yellow (Y) and cyan (C) developers, and a second laser scanning unit driver 214 to expose a second photoconductive drum 234 to develop magenta (M) and black (K) developers. The first and second laser scanning units drivers 212 and 214 respectively drive first and second laser scanning units 213 and 215, according to a signal of the controller 200, so that the first and the second laser scanning units 213 and 215 project a laser beam onto the first and the second photoconductive drums 232 and 234. Thereby, an electrostatic latent image is generated.

The developing unit driver 220, according to a signal from the controller 200, drives a developing unit to thereby change the electrostatic latent image formed on the first and the second photoconductive drums 232 and 234 into a visible image using yellow (Y), magenta (M), cyan (C), and black (K) developers.

The driver 230 for the photoconductive drum and intermediate transfer belt drives the first and second photoconductive drums 232 and 234, and the intermediate transfer belt 236, according to a signal from the controller 200.

The power supply unit 240, according to a signal from the controller 200, transfers onto the intermediate transfer belt 236 the visible image developed on the photoconductive drums 232 and 234. In addition, the power supply unit 240 supplies electric power to the first transfer unit 242, comprising first and second transfer rollers 242*a* and 242*b*, corresponding to the first and the second photoconductive drums 232 and 234, and to the second transfer unit 242 transferring to the printing medium the image transferred onto the first transfer unit.

The feeding motor 250 drives the pickup roller 254 and first and second feeding rollers 256 and 258, according to a signal from the controller 200. Clutches 252 are interposed among the feeding motor 250, the first and the second feeding roller 256 and 258, and the pickup roller 254 in order to connect and disconnect the feeding motor 250, with respect to the first and the second feeding rollers 256 and 258 and the pickup roller 254, under the control of the controller 200. By this, timing for moving the printing medium to the transfer position TP is enabled.

The memory 260 stores data received from the host device (not shown) and various other information used to operate the controller 200. As in the previously discussed embodiment, the lookup table is stored to the memory 260.

The first and the second sensors 270 and 275 are respectively disposed at the first and the second feeding rollers 256 and 258 to detect the printing medium being fed. Upon detection of the printing medium, the sensors 270 and 275 transmit appropriate information to the controller 200. A paper-jam sensor to detect occurrence of a paper jam is used as the first sensor 270, while a registration sensor used to arrange leading ends of the paper is used for the second sensor 275.

Hereinbelow, a method of controlling the transfer position on the printing medium, in a color image forming apparatus having the above described structure, will be described in greater detail.

Figure 8:
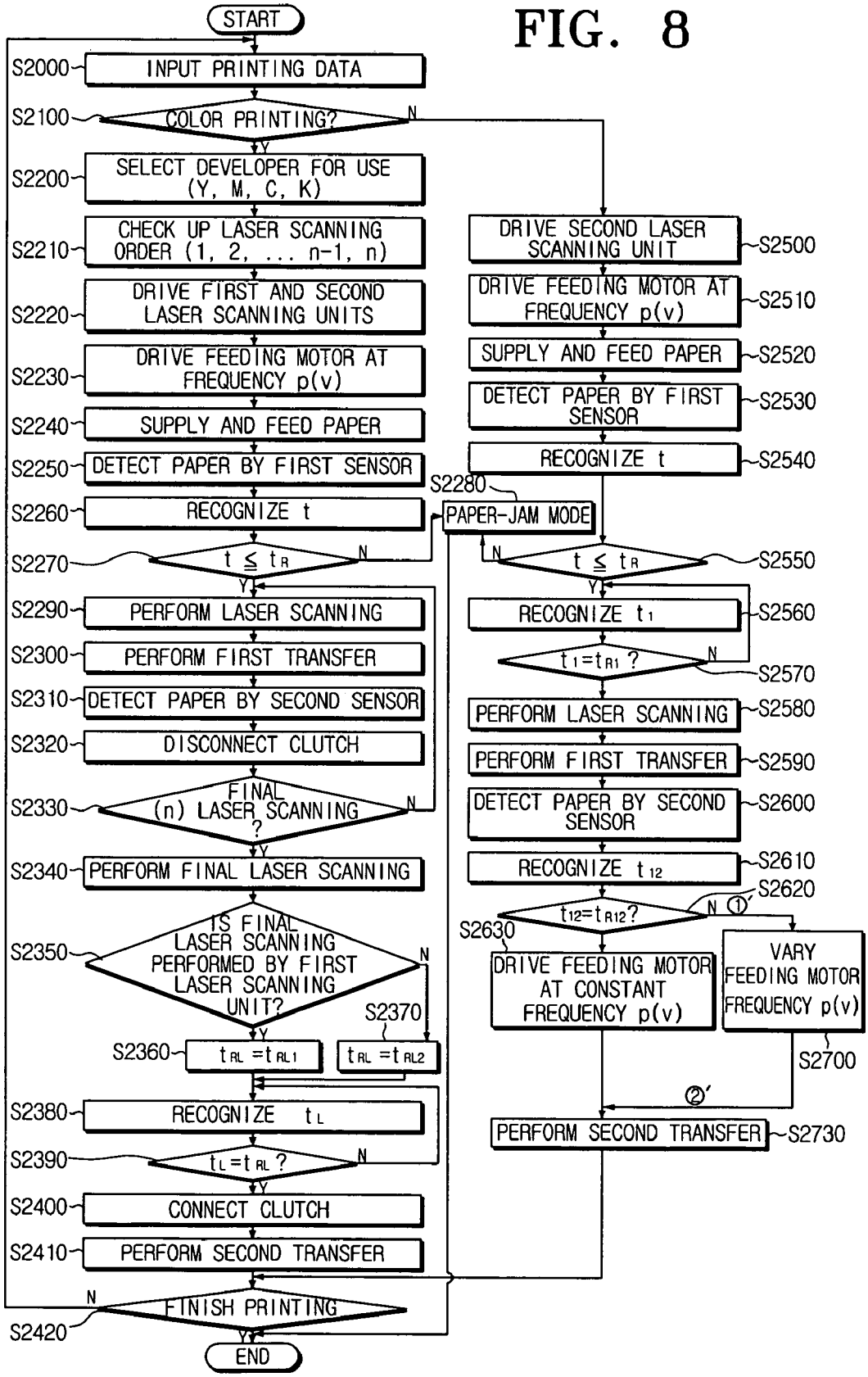
FIG. 8 is a flowchart illustrating a method of controlling a top margin of a printing medium of the color image forming apparatus of FIG. 6.

Referring to FIGS. 7 and 8, when the printing data is input from the host device such as a computer (S2000), the controller 200 determines whether the printing data is for color printing (S2100).

When implementing color printing, the controller 200 choose developers (Y, M, C, and K) for printing (S2200). The controller 200 checks up the number and order (1, 2, . . . n-1, n) of performing the laser scanning operation for the respective developers as chosen (S2210). The present embodiment takes 4 for 'n' as an example; however, 'n' may be more than 4 if the number of developer colors is more than 4. The controller 200 drives the laser scanning units 213 and 215 (S2220), drives the feeding motor 250 at driving frequency P (S2230) to supply the printing medium into the main body of the image forming apparatus, and feeds the printing medium at the printing medium feeding velocity V corresponding to the diving frequency P of the feeding motor 150 (S2240). Therefore, the first sensor 270 detects the printing medium being fed (S2250), recognizes the actual time 't' taken to receive the printing medium from the pickup point (S2260), and compares the actual time 't' to a reference time '$t_R$' for determining occurrence of a paper jam. When the actual time 't' is greater than the reference time '$t_R$', the controller 200 determines that a paper jam is generated, and converts to a paper-jam mode (S2280) to finish the processes. When the actual time 't' is equal to or smaller than the reference time '$t_R$', the controller 200 performs the laser scanning (S2290) and performs first transfer with respect to the intermediate transfer belt 236 (S2300). Here, the printing medium, being fed and passing through the first sensor 270, is detected by the second sensor 275 (S2310). Upon detection of the printing medium, or in a predetermined time after the detection, the controller 200 disconnects the clutches 252 (S2320) so that the power of the feeding motor 250 is not transmitted to the first and the second feeding rollers 256 and 258. Therefore, the printing medium stays on the second feeding roller 258. This is because more time is required to form a color image and perform secondary transfer than to pick up the printing medium and feed the printing medium to the transfer position TP.

In a state in which the printing medium stays on the second transfer roller 258, the controller 200 determines whether to perform a final laser scanning (S2330). If it is not a stage for the final laser scanning yet, the controller 200 repeats the processes for the laser scanning (S2290). If it is a stage for the final laser scanning, the controller 200 performs the final laser scanning (S2340). Then, the controller 200 determines whether the final laser scanning is performed by the first laser scanning unit 213 (S2350). If so, the controller 200 changes a preset reference time '$t_{RL}$' for determining a point of reconnecting the clutches 252 to a preset reference time '$t_{RL1}$' required for laser scanning by the first laser scanning unit 213 (S2360). If not, the controller 200 determines that the final laser scanning is performed by the second laser scanning unit 215 and therefore changes the preset reference time '$t_{RL}$' to a preset reference time '$t_{RL2}$' required for laser scanning by the second laser scanning unit 215 (S2370).

Here, the time '$t_{RL1}$' denotes a reference time taken from the start of laser scanning by the first laser scanning unit 213 to connection of the clutches 252. More specifically, the time '$t_{RL1}$' is calculated by subtracting the time taken from when the first laser scanning unit 213 starts laser scanning to when the image transferred on the intermediate transfer belt 236 reaches the transfer position TP, from the time taken from when the printing medium, detected by the second sensor 275 and staying on the second feeding roller 258, starts being fed to when the printing medium reaches the transfer position TP. The time '$t_{RL2}$' denotes a reference time taken from the start of laser scanning by the second laser scanning unit 215 to connection of the clutches 252. More specifically, the time '$t_{RL2}$' is calculated by subtracting the time taken from when the second laser scanning unit 215 starts laser scanning to when the image transferred on the intermediate transfer belt 236 reaches the transfer position TP, from the time taken from when the printing medium, detected by the second sensor 275 and staying on the second feeding roller 258, starts being fed to when the printing medium reaches the transfer position TP. The times '$t_{RL1}$' and '$t_{RL2}$' are determined through the feeding motor driving frequency P, a distance from the second sensor 275 to the transfer position TP, a driving velocity of the intermediate transfer belt 236, and distances from laser scanning positions on the photoconductive drums 232 and 235 to the transfer position TP.

The controller 200 recognizes the actual time $t_L$ actually taken from the final laser scanning point (S2380) and determines whether the actual time $t_L$ is equal to the preset reference time $t_{RL}$ (S2390). When they are not equal to each other, the controller 200 repeats the processes of recognizing the actual time $t_L$ (S2380). When the actual time $t_L$ is equal to the preset reference time $t_{RL}$, the controller 200 connects the clutches 252 so that the first and second feeding rollers 256 and 258 can be powered by the feeding motor 250. Having received this power, the second feeding roller 258 moves the printing medium to the transfer position TP. Here, the image transferred on the intermediate transfer belt 236 reaches the transfer position TP simultaneously with the printing medium, thereby enabling the secondary transfer of the image transferred on the intermediate transfer belt 236 on a correct position of the printing medium (S2410). After the secondary transfer and further processes such as image fixing, one sheet of printing medium is completed with the printing operation. The controller 200 determines whether the printing operation is completed (S2420) and, if not, restarts from input of the printing data (S2000).

Non-color printing refers to monochromatic printing in which a developer of only one color out of the respective color developing units is used for printing. In other words, printing is embodied with only one color among yellow (Y), magenta (M), cyan (C), and black (K). In this embodiment, black (K) is used as an example.

When implementing non-color printing, the controller 200 operates the second laser scanning unit 215 (S2500) and drives the feeding motor 250 at the driving frequency P (S2510). Accordingly, the printing medium is supplied from the multifunction paper feeding unit 280 or the paper feeding cassette 285 into the main body of the image forming apparatus and fed at the feeding velocity V (S2520). Therefore, the first sensor 270 detects the printing medium being fed, and the controller 200 recognizes the actual time 't' actually taken from the pickup point to the detecting point by the first sensor 270 (S2540) and compares the actual time 't' with the preset reference time '$t_R$' (S2550). When the actual time 't' is greater than the reference time '$t_R$', the controller 200 converts to a paper-jam mode (S2280). When the actual time 't' is equal to or smaller than the reference time '$t_R$', the controller 200 recognizes the actual time '$t_1$' actually taken from when the first sensor 70 detects the printing medium (S2560), and determines whether the actual time '$t_1$' is equal to the reference time '$t_{R1}$' (S2570). Here, the reference time '$t_{R1}$' denotes a time required from when the first sensor 270 detects the printing medium to when the laser scanning operation begins. The reference time '$t_{R1}$' is determined based on a distance between the laser scanning position to the transfer position TP, a driving velocity of the intermediate transfer belt 236, a distance between the first sensor 270 to the transfer position TP, and a feeding velocity V of the printing medium. When the actual time '$t_1$' is not equal to the reference time '$t_{R1}$' as a result of comparison, the controller 200 repeats the process of recognizing the actual time '$t_1$' (S2560). When the actual time '$t_1$' and the reference time '$t_{R1}$' correspond, the controller 200 performs the laser scanning (S2580) and the first transfer (S2590). When the printing medium being fed is detected by the second sensor 275 (S2600), the controller 200 recognizes an actual time '$t_{12}$' taken from a point of detecting the printing medium by the first sensor 270 to a point of detecting the printing medium by the second sensor 275 (S2610), and compares the actual time '$t_{12}$' with the reference time '$t_{R12}$' (S2620). The reference time '$t_{R12}$' refers to a time normally taken for the printing medium being fed at the feeding velocity V according to the feeding motor driving frequency P to be moved from the first sensor 270 to the second sensor 275.

When the actual time '$t_{12}$' and the reference time '$t_{R12}$' are equal to each other, the printing medium is fed at a constant velocity 'v' without varying a feeding motor driving frequency 'p' (S2630). As the printing medium being fed reaches the transfer position TP, the secondary transfer is performed (S2730).

When the actual time '$t_{12}$' is different from the reference time '$t_{R12}$', the controller 200 varies the feeding velocity 'v' of the printing medium by varying the driving frequency 'p' of the feeding motor 250 (S2700).

Figure 9:
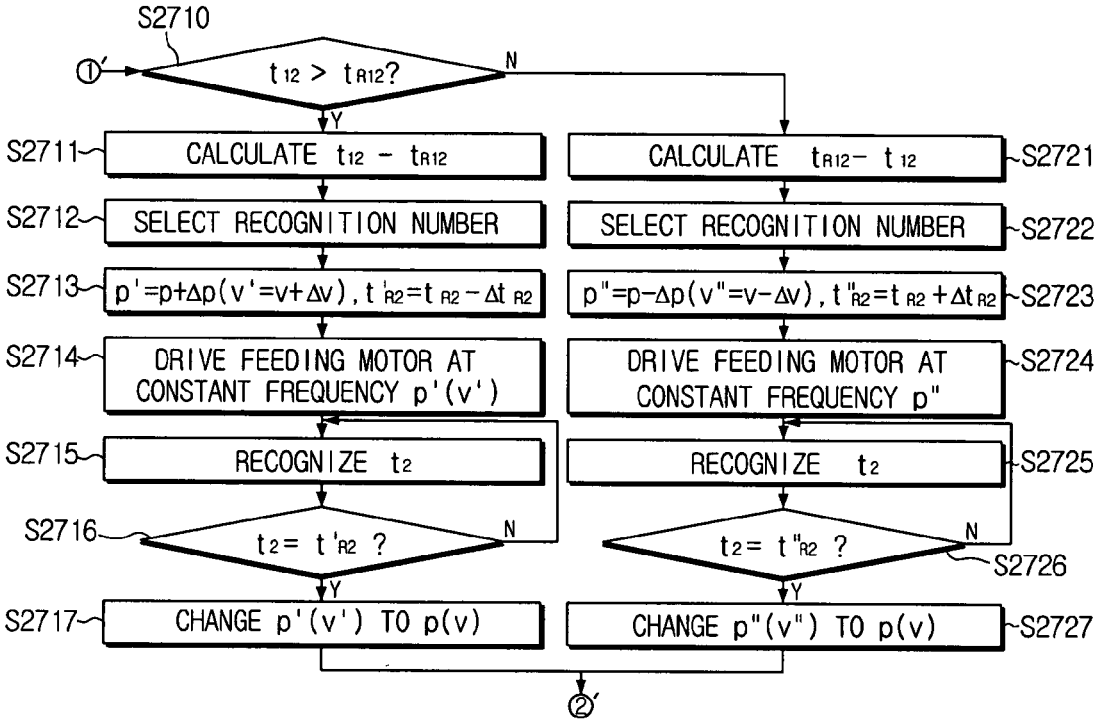
FIG. 9 is a flowchart illustrating a method of varying a transfer motor frequency P of FIG. 8.

FIG. 9 illustrates a detailed flowchart regarding the processes of varying the feeding motor driving frequency 'p'.

When the actual time '$t_{12}$' is different from the reference time '$t_{R12}$', the controller 200 determines whether the actual time '$t_{12}$' is greater than the reference time '$t_{R12}$' (S2710). If so, the controller 200 varies the feeding motor driving frequency in the same manner as in the previously described embodiment of the present invention.

TABLE 2

Lookup Table

| Recognition No. | $\lvert t_{12} - t_{R12}\rvert$ | Change ($\Delta p$) of feeding motor driving frequency (p) | Change ($\Delta t_{R2}$) of preset time for restoration of feeding motor driving frequency (p) |
|---|---|---|---|
| 1 | $0 < \lvert t_{12} - t_{R12}\rvert \leqq \Delta t_1$ | $\Delta p_1$ | $\Delta t_{R21}$ |
| 2 | $\Delta t_1 < \lvert t_{12} - t_{R12}\rvert \leqq \Delta t_2$ | $\Delta p_2$ | $\Delta t_{R22}$ |
| 3 | $\Delta t_2 < \lvert t_{12} - t_{R12}\rvert \leqq \Delta t_3$ | $\Delta p_3$ | $\Delta t_{R23}$ |
| 4 | $\Delta t_3 < \lvert t_{12} - t_{R12}\rvert \leqq \Delta t_4$ | $\Delta p_4$ | $\Delta t_{R24}$ |
| 5 | $\Delta t_4 < \lvert t_{12} - t_{R12}\rvert \leqq \Delta t_5$ | $\Delta p_5$ | $\Delta t_{R25}$ |
| 6 | $\Delta t_5 < \lvert t_{12} - t_{R12}\rvert \leqq \Delta t_6$ | $\Delta p_6$ | $\Delta t_{R26}$ |

TABLE 2-continued

Lookup Table

| Recognition No. | $\lvert t_{12} - t_{R12}\rvert$ | Change ($\Delta p$) of feeding motor driving frequency (p) | Change ($\Delta t_{R2}$) of preset time for restoration of feeding motor driving frequency (p) |
|---|---|---|---|
| 7 | $\Delta t_6 < \lvert t_{12} - t_{R12}\rvert \leqq \Delta t_7$ | $\Delta p_7$ | $\Delta t_{R27}$ |
| 8 | $\Delta t_7 < \lvert t_{12} - t_{R12}\rvert \leqq \Delta t_8$ | $\Delta p_8$ | $\Delta t_{R28}$ |
| 9 | $\Delta t_8 < \lvert t_{12} - t_{R12}\rvert \leqq \Delta t_9$ | $\Delta p_9$ | $\Delta t_{R29}$ |
| 10 | $\Delta t_9 < \lvert t_{12} - t_{R12}\rvert \leqq \Delta t_{10}$ | $\Delta p_{10}$ | $\Delta t_{R210}$ |

In greater detail, a recognition number is selected through calculating $t_{12}$-$t_{R12}$ (S2711) and the controller 200 selects the variation $\Delta p$ of the feeding motor driving frequency 'p' according to the selected recognition number. Therefore,an updated feeding motor driving velocity frequency 'p'' is calculated by adding the variation $\Delta p$ to the original feeding velocity frequency 'p' (S2713). According to the selected recognition number, in addition, variation $\Delta t_{R2}$ of preset reference time $t_{R2}$ is selected to restore the updated feeding motor driving frequency 'p'' to the original feeding motor frequency 'p'. Then, an updated reference time $t_{R2}$, is calculated by subtracting the variation $\Delta t_{R2}$ from the present reference time $t_{R2}$ (S2713). The printing medium is fed by driving the feeding motor 250 according to the updated feeding motor driving frequency 'p'' (S2714). The controller 200 recognizes the actual time '$t_2$' taken from when the second sensor 275 detects the printing medium (S2715) and compares the actual time '$t_2$' with the updated reference time '$t_{R2}$' (S2716). When the actual time '$t_2$' and the reference time '$t_{R2}$' are equal to each other, the updated feeding motor driving frequency 'p'' is restored to the original feeding motor driving frequency 'p' (S2717) to perform the transferring operation (S2730). After the transfer, the controller 200 determines whether the printing operation is completed (S2420) as described above.

When the actual time '$t_{12}$' is not greater than the reference time '$t_{R12}$', that is, when the actual time '$t_{12}$' is less than the reference time '$t_{R12}$', the recognition number is selected (S2722) by subtracting the actual time $t_{12}$ from the reference time $t_{R12}$ (S2721). Further, the variation $\Delta p$ of the feeding motor driving frequency 'p' is selected, and the selected variation $\Delta p$ is subtracted from the original feeding motor driving frequency 'p', thereby calculating an updated driving frequency 'p"' (S2723). According to the selected recognition number, in addition, variation $\Delta t_{R12}$ of preset reference time $t_{R2}$ is selected to restore the updated feeding motor driving frequency 'p"' to the original feeding motor frequency 'p'. Then, an updated reference time $t_{R2}$" is calculated by adding the variation $\Delta t_{R2}$ to the preset reference time $t_{R2}$ (S2723). The printing medium is fed by driving the feeding motor 250 according to the updated feeding motor driving frequency 'p"' (S2724). The controller 200 recognizes the actual time '$t_2$' taken from when the second sensor 275 detects the printing medium (S2725) and compares the actual time '$t_2$' with the updated reference time '$t_{R2}$' (S2726). When the actual time '$t_2$' and the reference time '$t_{R2}$' are equal to each other, the updated feeding motor driving frequency 'p"' is restored to the original feeding motor driving frequency 'p' (S2727) to perform the transferring operation (S2730). After the transfer, the controller 200 determines whether the printing operation is completed (S2420) as described above.

As can be appreciated from the above description, according to embodiments of the present invention, discrepancy in feeding velocity of the printing medium, caused due to abrasion or slips between the feeding rollers and the printing medium, can be compensated for. Accordingly, loss of information to be printed can be prevented and, furthermore, transfer of the image can be correctly achieved on a desired position of the printing medium.

Therefore, image forming quality can be enhanced.

Also, when implementing monochromatic printing in a color image forming apparatus, the feeding velocity of the printing medium can be independently controlled, thereby enhancing the speed of the monochromatic printing.

In addition, since a paper-jam sensor and a registration sensor may be used as the sensors detecting the printing medium, regulation of a top margin is enabled without adding dedicated parts.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising:

a feeding roller;

a feeding motor to drive the feeding roller to move a picked-up printing medium; and a controller to control the feeding motor so as to regulate a feeding velocity of the printing medium according to a feeding time $T_{12}$ taken to move the printing medium within a predetermined section of a printing medium feeding path, wherein the controller drives the feeding motor at a predetermined motor driving frequency P within the predetermined section;

varies the predetermined feeding motor driving frequency P, according to the feeding time $T_{12}$ taken to move the printing medium within the predetermined section, in a post section after the predetermined section; and restores the predetermined motor driving frequency P at a reference time after beginning to vary the driving frequency of the feeding motor.

2. The image forming apparatus of claim 1, further comprising a memory to store a lookup table comprising detailed values of a variation ΔP of a predetermined motor driving frequency P corresponding to a comparison between the feeding time $T_{12}$ and a reference time $T_{R12}$;

wherein, when $T_{12}=T_{R12}$, the controller drives the feeding motor at the predetermined driving frequency P after the feeding time $T_{12}$ and when $T_{12}\neq T_{R12}$, varies the predetermined motor driving frequency P by adding or subtracting the variation ΔP, selected from the lookup table based on the comparison between the feeding time $T_{12}$ and the reference time $T_{R12}$, with respect to the predetermined driving frequency P.

3. The image forming apparatus of claim 2, wherein the feeding time $T_{12}$ denotes a time from the printing medium being picked up to the printing medium being detected by a sensor mounted on the printing medium feeding path.

4. The image forming apparatus of claim 3, wherein the lookup table stores detailed values of a variation $\Delta T_{R2}$ of a reference time $T_{R2}$ used to restore the predetermined motor driving frequency P corresponding to the comparison between the feeding time $T_{12}$ and the reference time $T_{R12}$;

wherein the controller varies the reference time $T_{R2}$ by adding or subtracting the variation $\Delta T_{R2}$, selected from the lookup table based on the comparison between the feeding time $T_{12}$ and the reference time $T_{R12}$, and restores the predetermined driving frequency P at the varied reference time $T_{R2}$ after detecting the printing medium by the sensor.

5. The image forming apparatus of claim 2, further comprising:

a first sensor mounted on the printing medium feeding path; and a second sensor mounted on the printing medium feeding path at a predetermined distance from the first sensor;

wherein the feeding time $T_{12}$ denotes a time taken from the first sensor detecting the printing medium to the second sensor detecting the printing medium.

6. The image forming apparatus of claim 5, wherein the lookup table stores detailed values of a variation $\Delta T_{R2}$ of a reference time $T_{R2}$ used to restore the predetermined motor driving frequency P corresponding to the comparison between the feeding time $T_{12}$ and the reference time $T_{R12}$;

wherein the controller varies the reference time $T_{R2}$ by adding or subtracting the variation $\Delta T_{R2}$, selected from the lookup table based on the comparison between the feeding time $T_{12}$ and the reference time $T_{R12}$, and restores the predetermined driving frequency P at the varied reference time $T_{R2}$ after detecting the printing medium by the second sensor.

7. A method of controlling a top margin on a printing medium in an image forming apparatus, the method comprising:

feeding the printing medium at a constant velocity V within a predetermined section of a printing medium feeding path; and varying a predetermined feeding velocity of the printing medium after an actual time $T_{12}$ taken to move the printing medium within the predetermined section, wherein the predetermined section is a section from a point at which the printing medium is supplied to a point at which the printing medium is detected by a sensor mounted on the printing medium feeding path, and the varying of the predetermined feeding velocity comprises:

comparing the actual time $T_{12}$ with a reference time $T_{R12}$; and varying the predetermined feeding velocity of the printing medium in response to the actual time $T_{12}$ not being equal to the reference time $T_{Rl2}$, and wherein the varying the predetermined feeding velocity comprises:

varying the predetermined feeding velocity of the printing medium by a predetermined variation ΔV according to a difference between the actual time $T_{12}$ and the reference time $T_{R12}$; and restoring the predetermined feeding velocity before the printing medium, which is being fed at the varied feeding velocity, reaches the transfer position TP.

8. The method of claim 7 further comprising maintaining the predetermined feeding velocity of the printing medium in response to the actual time $T_{12}$ being equal to the reference time $T_{R12}$.

9. The method of claim 7 wherein the varying the predetermined feeding velocity by the predetermined variation ΔV comprises increasing the predetermined feeding velocity of the printing medium by the predetermined variation ΔV in response to the actual time $T_{12}$ being greater than the reference time $T_{R12}$ and decreasing the predetermined feeding velocity by the predetermined variation ΔV in response to the actual time $T_{12}$ being smaller than the reference time $T_{R12}$.

10. The method of claim 7 wherein the restoring the predetermined feeding velocity comprises:

varying a reference time $T'_{2R}$, used to restore the predetermined feeding velocity according to the variation $\Delta V$, by a predetermined variation $\Delta T_{2R}$;

comparing an actual time $T_2$, taken from a point of varying the predetermined feeding velocity of the printing medium, with the varied reference time $T'_{2R}$; and restoring the predetermined feeding velocity in response to the actual time $T_2$ being equal to the varied reference time $T'_{2R}$.

11. The method of claim 10, wherein the varying the reference time $T_{2R}$ comprises decreasing the reference time $T_{2R}$ by the predetermined variation $\Delta T_{2R}$ in response to the predetermined feeding velocity being increased by the variation $\Delta V$, and increasing the reference time $T_{2R}$ by the predetermined variation $\Delta T_{2R}$ in response to the predetermined feeding velocity being decreased by the variation $\Delta V$.

12. The method of claim 7, wherein the image forming apparatus comprises:

a first sensor mounted on the printing medium feeding path; and a second sensor mounted on the printing medium feeding path at a predetermined distance from the first sensor toward the second sensor;

wherein the predetermined section is a section from a point at which the first sensor detects the printing medium to a point at which the second sensor detects the printing medium, and the varying of the predetermined feeding velocity comprises:

comparing the actual time $T_{12}$, taken from the point at which the first sensor detects the printing medium to the point at which the second sensor detects the printing medium, with a reference time $T_{R12}$; and varying the predetermined feeding velocity of the printing medium in response to the actual time $T_{12}$ not being equal to the reference time $T_{R12}$.

13. The method of claim 12, further comprising maintaining the predetermined feeding velocity of the printing medium in response to the actual time $T_{12}$ being equal to the reference time $T_{R12}$.

14. The method of claim 13, further comprising the steps of:

comparing an actual time $T_1$ taken from the point at which the first sensor detects the printing medium with a reference time $T_{R1}$ to start a laser scanning operation; and starting the laser scanning operation in response to the actual time $T_1$ being equal to the reference time $T_{R1}$.

15. The method of claim 12, wherein the varying the predetermined feeding velocity of the printing medium comprises:

calculating a difference between the actual time $T_{12}$ and the reference time $T_{R12}$ and varying the predetermined feeding velocity of the printing medium by a predetermined variation $\Delta V$ according to the calculation result; and restoring the predetermined feeding velocity of the printing medium before the printing medium, which is being fed at the varied feeding velocity, reaches the transfer position TP.

16. The method of claim 15, wherein the varying the predetermined feeding velocity comprises increasing the predetermined feeding velocity of the printing medium by the predetermined variation $\Delta V$ in response to the actual time $T_{12}$ being greater than the reference time $T_{R12}$, and decreasing the predetermined feeding velocity by the predetermined variation $\Delta V$ in response to the actual time $T_{12}$ being smaller than the reference time $T_{R12}$.

17. The method of claim 15, wherein the restoring the predetermined feeding velocity comprises:

varying a reference time $T'_{2R}$, used to restore the predetermined feeding velocity according to the variation $\Delta V$, by a predetermined variation $\Delta T_{R2}$;

comparing an actual time $T_2$, taken from a point of detecting the printing medium by the second sensor, with the varied reference time $T'_{R2}$; and restoring the predetermined feeding velocity in response to the actual time $T_2$ being equal to the varied reference time $T'_{R2}$.

18. The method of claim 17, wherein the varying the reference time $T_{2R}$ comprises decreasing the reference time $T_{2R}$ by the predetermined variation $\Delta T_{2R}$ in response to the predetermined feeding velocity being increased by the variation $\Delta V$, and increasing the reference time $T_{2R}$ by the predetermined variation $\Delta T_{R2}$ in response to the predetermined feeding velocity being decreased by the variation $\Delta V$.

19. An image forming apparatus comprising:

a feeding roller to move a printing medium along a feeding path; and a controller to regulate a feeding velocity of the feeding roller according to a sensed time between two points on the feeding path, wherein the sensed time is compared to a reference time, and the feeding velocity is then adjusted according to a difference between the sensed time and the reference time, and wherein the feeding velocity is returned to a pre-adjustment value after a predetermined time.

20. The image forming apparatus of claim 19, wherein the predetermined time is taken from a plurality of predetermined times stored in the image forming apparatus, and is chosen according to the adjusted feeding velocity.

21. A method of controlling a feeding velocity of a printing medium in an image forming apparatus, the method comprising:

sensing a time between two points on a feeding path on which the printing medium is moving;

regulating the feeding velocity of the printing medium according to the sensed time; and returning the feeding velocity to a pre-adjustment value after a predetermined time, wherein the regulating the feeding velocity of the printing medium comprises comparing the sensed time to a reference time, and then adjusting the feeding velocity according to a difference between the sensed time and the reference time.

22. The image forming apparatus of claim 21, further comprising choosing the predetermined time from a plurality of predetermined times stored in the image forming apparatus according to the adjusted feeding velocity.

* * * * *

UNITED STATES PATENT AND TRADEMARK OFFICE

CERTIFICATE OF CORRECTION

PATENT NO. : 7,545,400 B2
APPLICATION NO. : 11/262709
DATED : June 9, 2009
INVENTOR(S) : Byung-sun Ahn It is certified that error appears in the above-identified patent and that said Letters Patent is hereby corrected as shown below:

First Page, Item (73) (Assignee), Line 2, change "Suwom-Si" to --Suwon-Si--.

Column 14, Line 44, change "$T_{Rl2}$," to --$T_{R12}$,--.

Column 14, Line 63, change "$T_{R12}$" to --$T_{R12}$,--.

Signed and Sealed this

Thirteenth Day of October, 2009

David J. Kappos

David J. Kappos
*Director of the United States Patent and Trademark Office*